US006299223B1

(12) United States Patent
Ji et al.

(10) Patent No.: US 6,299,223 B1
(45) **Date of Patent: *Oct. 9, 2001**

(54) PLUNGER LATCH

(75) Inventors: Lianli Ji, West Chester, PA (US); Ralph C. Ulisse, Glassboro, NJ (US)

(73) Assignee: Southco, Inc., Concordville, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/317,471

(22) Filed: May 24, 1999

Related U.S. Application Data

(60) Provisional application No. 60/106,994, filed on Nov. 4, 1998, provisional application No. 60/097,014, filed on Aug. 18, 1998, and provisional application No. 60/091,147, filed on Jun. 29, 1998.

(51) Int. Cl.[7] ..... E05C 1/10

(52) U.S. Cl. ..... 292/175

(58) Field of Search ..... 292/174, 175, 292/DIG. 29, DIG. 37, DIG. 38, DIG. 35, DIG. 63, DIG. 53, 89, 57, 58, 60, 61, 67; 74/527; 403/326, 329, 109.3

(56) References Cited

U.S. PATENT DOCUMENTS 265,474 * 10/1882 Voll ..... 292/DIG. 53
1,653,553 * 12/1927 Edelmann ..... 292/175
3,233,932 * 2/1966 Utterback ..... 292/175
3,397,000 * 8/1968 Nakanishi ..... 292/61
4,597,599 7/1986 Bisbing ..... 292/174
4,699,406 * 10/1987 Swanson ..... 292/175
4,798,271 * 1/1989 Gattermann ..... 74/527
5,165,738 * 11/1992 Mccormack ..... 292/67
5,769,472 * 6/1998 Small ..... 292/DIG. 53

FOREIGN PATENT DOCUMENTS

211460 * 12/1940 (CH) ..... 292/175
400325 * 10/1933 (GB) ..... 292/175

OTHER PUBLICATIONS

Southco Fasteners Handbook 40 (Southco Inc., Pennsylvania, 1990) pp. G–13, G–14, G–15, G–16, J–4, J–5 and J–6.

* cited by examiner

*Primary Examiner*—B. Dayoan
(74) *Attorney, Agent, or Firm*—Paul & Paul

(57) ABSTRACT

A plunger latch includes a housing and a generally elongate shaft that is driven in the housing between extended and retracted positions. A spring or similar member can be provided for urging the shaft to its extended position. Also, the plunger latch can be adapted so that the shaft is retained in its extended position and/or its retracted position.

15 Claims, 12 Drawing Sheets

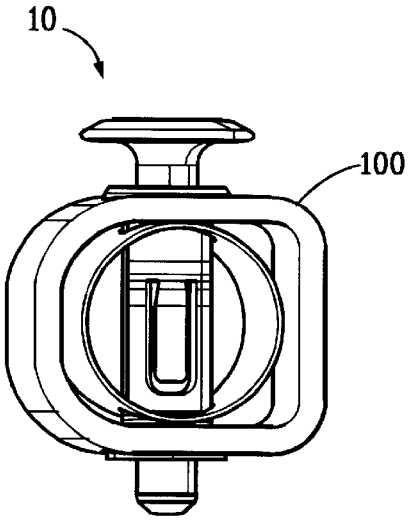
FIG. 1
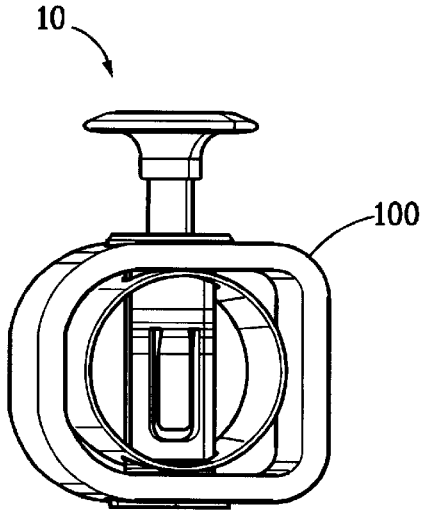
FIG. 2
FIG. 3
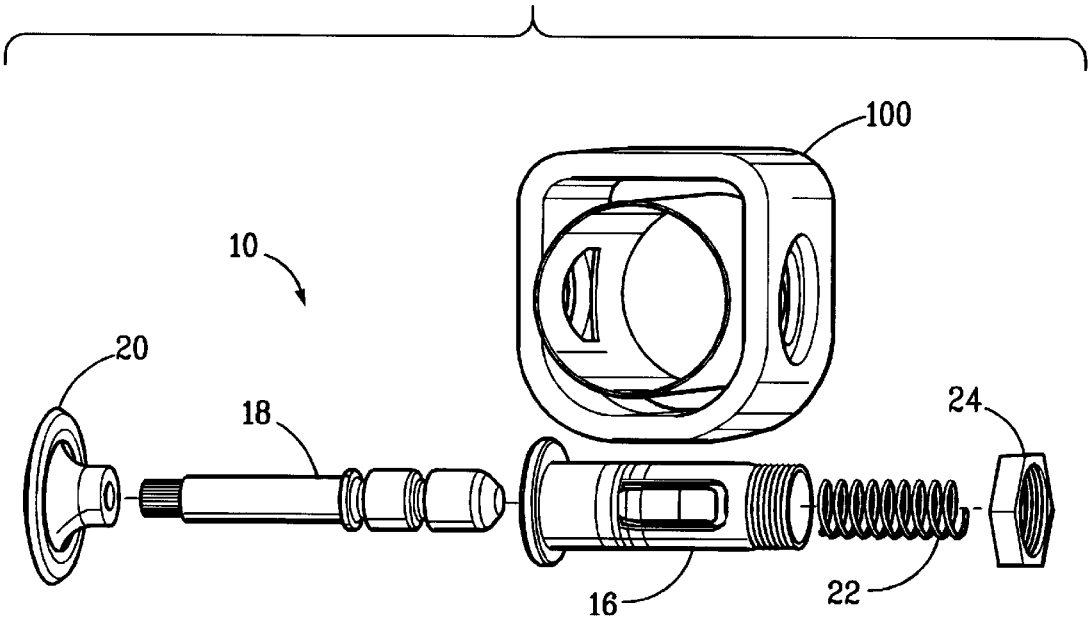

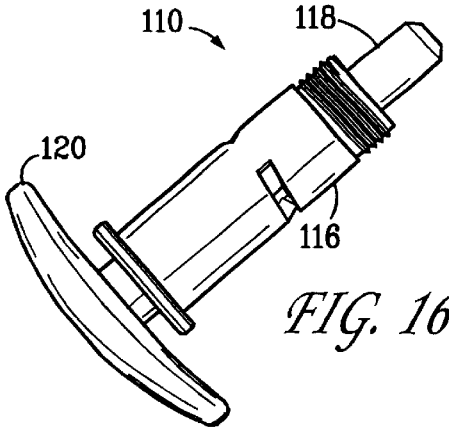
FIG. 16
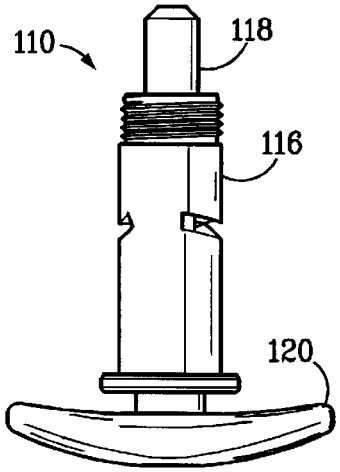
FIG. 17
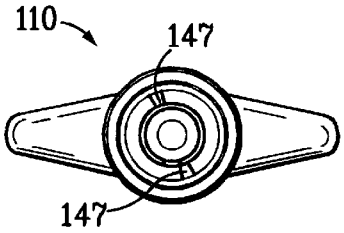
FIG. 18
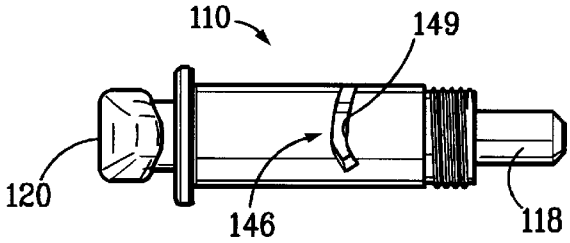
FIG. 19
FIG. 20
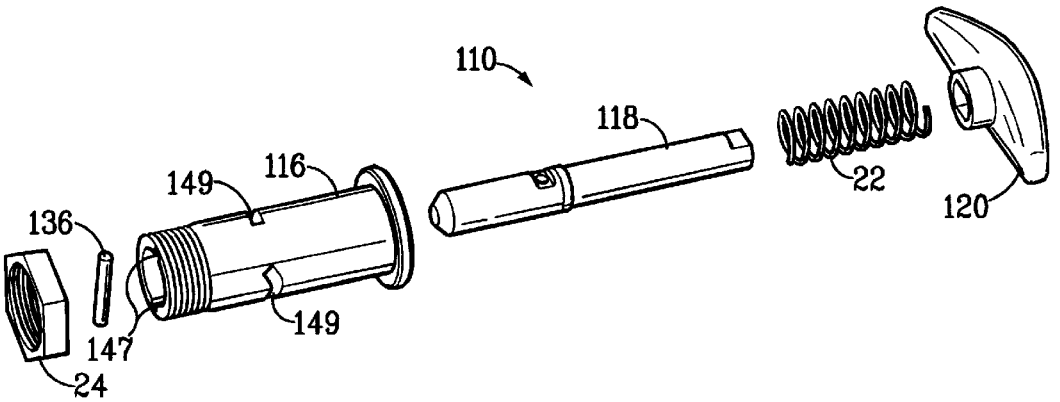

PLUNGER LATCH

CROSS-REFERENCE TO RELATED APPLICATIONS

This is a conventional patent application based on U.S. provisional patent application Ser. No. 60/106,994 filed Nov. 4, 1998; Ser. No. 60/097,014 filed Aug. 18, 1998 and Ser. No. 60/091,147 filed Jun. 29, 1998.

BACKGROUNG OF THE INVENTION

1. Field of the Invention

The present invention relates generally to latching devices and more particularly to latching devices having a reciprocating action between extended and retracted positions.

2. Brief Description of the Prior Art

Various latching devices are known in the art for securing together two or more members, such as panels, covers, lids or the like. The present invention has been developed in view of the prior art to provide a latching device capable of retaining members securely in a latched position and which can be operated both quickly and easily.

SUMMARY OF THE INVENTION

The present invention discloses a latching device capable of retaining members securely in a latched position and which can be operated both quickly and easily. For this purpose, in one embodiment the present invention discloses a plunger latch comprising a housing, a shaft and means for driving the shaft between extended and retracted positions.

BRIEF DESCRIPTION OF THE DRAWINGS

FIG. 1 is a side elevational view of an embodiment of a plunger mechanism in accordance with the present invention illustrated in an extended position and mounted in a portion of a first member.

FIG. 2 is a side elevational view of the plunger mechanism of FIG. 1 again illustrated mounted in a portion of a first member and shown in a retracted position.

FIG. 3 is an exploded perspective view of the plunger mechanism of FIG. 1.

FIG. 16 is a perspective view of a plunger mechanism in accordance with another embodiment of the present invention.

FIG. 17 is a front elevational view of the plunger mechanism of FIG. 16.

FIG. 18 is a top plan view of the plunger mechanism of FIG. 16.

FIG. 19 is a left side elevational view of the plunger mechanism of FIG. 16, the right side being a mirror image.

FIG. 20 is a exploded perspective view of the plunger mechanism of FIG. 16.

DETAILED DESCRIPTION OF THE PREFERRED EMBODIMENTS

Figure 3A:
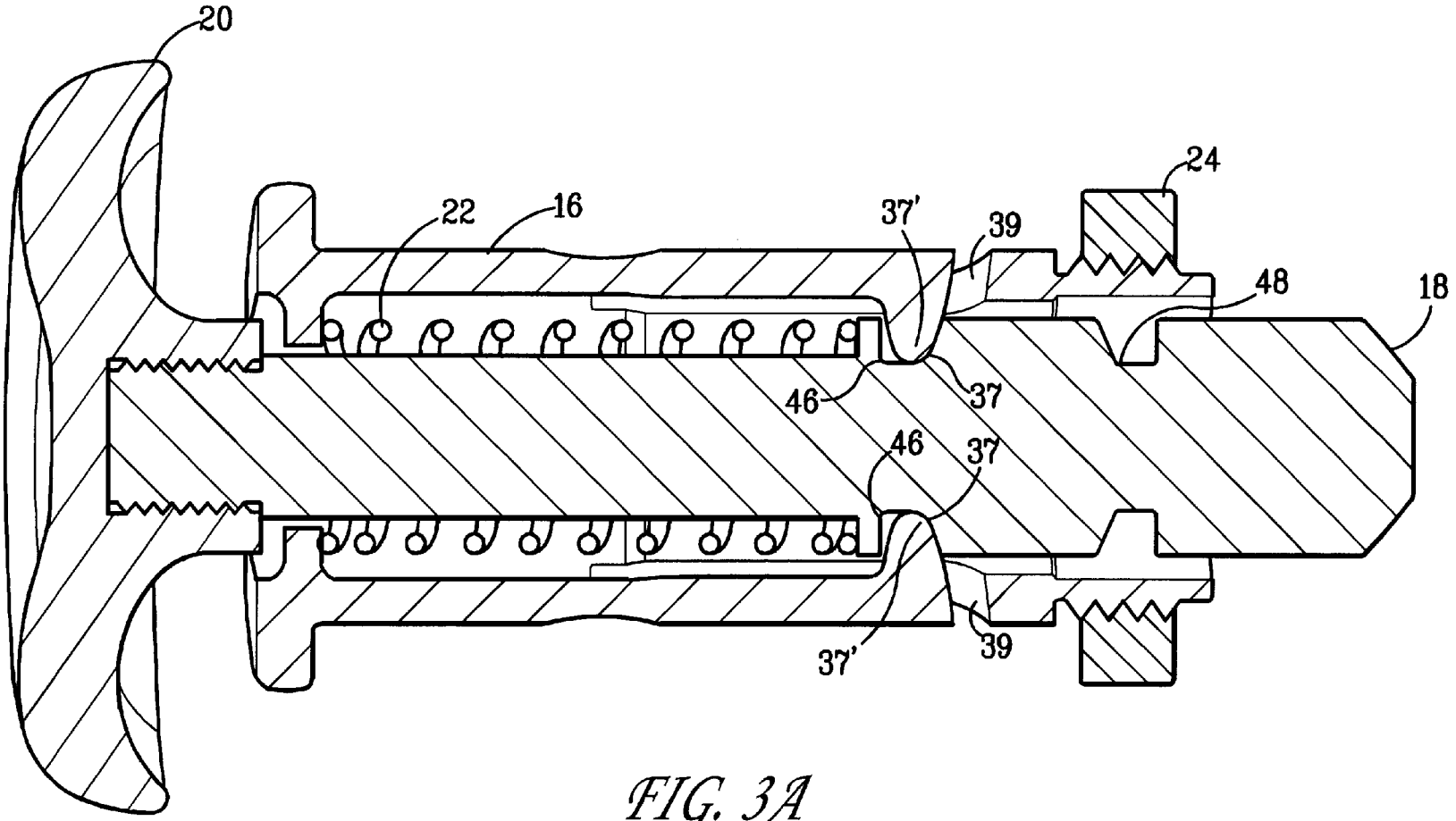
FIG. 3*a* is a sectional view of the plunger mechanism of FIG. 1, taken longitudinal through the center.
Figure 4:
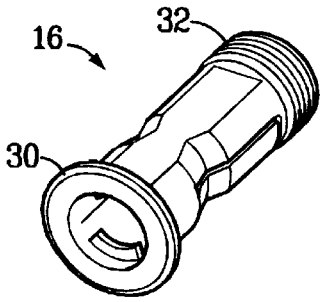
FIG. 4 is an isolated perspective view of a housing of the plunger mechanism of FIG. 1.

Referring now to the drawings in detail, wherein elements described herein will be numbered in accordance with the numbered elements illustrated in the attached drawings, in FIGS. 1–15 is illustrated an embodiment of a plunger mechanism in accordance with the present invention. The plunger mechanism 10 in the present embodiment is illustrated mounted in a portion of a first member 100. In operation, the plunger mechanism 10 is adapted for latching the first member 100 to a second member which is not shown. In this embodiment, the first member 100 comprises an extension mechanism generally semi-circular in shape for the tail gate of a pick-up truck and comprises an inner tubular portion and an outer tubular portion. The second member comprises a portion of the pick-up truck having a keeper in the form of a receptacle. As should be understood, the first member 100 and second member can be any of a variety of different structural components, such as doors, panels and the like. As illustrated in FIG. 1, the outer and inner tubular portions of the first member 100 are each provided with a pair of opposing apertures therethrough and with the apertures in each of the outer and inner tubular portions being aligned in order to receive the plunger mechanism 10 for mounting. The plunger mechanism 10 of FIG. 1 is illustrated in an extended position and in FIG. 2 in a retracted position. The components of the plunger mechanism 10 in the present embodiment will be described in more detail below.

As illustrated in the exploded perspective view of FIG. 3, the plunger mechanism 10 includes, as portions thereof, a housing 16, a shaft 18 and means for driving the shaft 18 comprising a knob 20 in this embodiment. In addition, in the present embodiment, the plunger mechanism 10 also preferably includes a biasing member comprising a spring 22 and means for securing the plunger mechanism 10 in the first member 100 comprising a nut 24.

As illustrated in FIGS. 4–7, the housing 16 is a generally tubular member including in this embodiment a flange 30 at one end, a threaded portion 32 on its outer surface proximate a second end and an opening or bore 34 extending longitudinally through the housing 16.

The shaft 18 is illustrated in FIGS. 8–11 and defines a generally cylindrical member and includes means 40 at one end for attachment to the knob 20. In this embodiment, the means 40 defines a double D cross-sectional portion of the shaft 18 and which includes opposing serrated surfaces 42. In addition, the shaft 18 includes at its opposite end distal the portion 40 a latching member 44 terminating by a generally conical shaped extension.

The knob 20 is illustrated in FIGS. 12–15 and includes an inner surface 50 having a cavity therein for press fit engagement with the portion 40 of the shaft 18, although as should be understood, other means for attachment of the knob 20 and shaft 18 can also be utilized, such as a threaded engagement which is illustrated in FIG. 3*a*. The knob 20 also includes a substantially annular outer surface 52.

Figure 6:
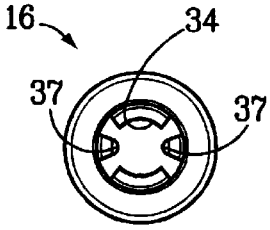
FIG. 6 is a bottom plan view of the housing of FIG. 4.
Figure 7:
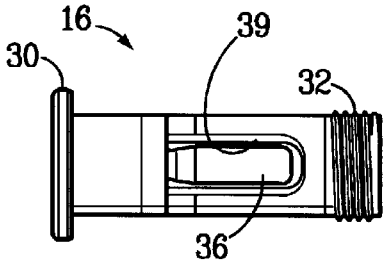
FIG. 7 is a left side elevational view of the housing of FIG. 4, the right side being a mirror image.
Figure 8:
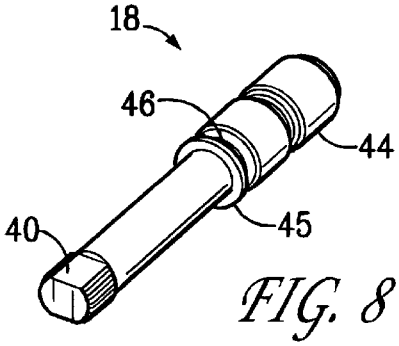
FIG. 8 is an isolated perspective view of a shaft of the plunger mechanism of FIG. 1.

For assembly, the shaft 18 is mounted in the opening 34 through the housing 16. The spring 22 can also be provided where desired mounted preferably onto the shaft 18 prior to attachment of the shaft 18 to the knob 20, with the spring 22 being received onto the end having the portion 40. In this embodiment, the shaft 18 also includes a shoulder 45 against which the spring 22 engages. In operation, the plunger 10 is operable as the shaft 18 is reciprocated between extended and retracted positions. The spring 22 operates to bias the shaft 20 towards its extended position. In accordance with the present invention, means are provided for accommodating the reciprocal movement of the shaft between its retracted and extended positions, as will be described in detail hereinafter. In this embodiment, the shaft 18 is movable axially between its extended and retracted positions. Specifically, the shaft 18 is retracted against the bias of spring 22 through application of a suitable lifting force, such as by an operator grasping the knob 20. As will be described in detail below, in this embodiment the shaft 18 is moved from its retracted position to its extended position by applying a suitable pushing force to the knob 20, and the bias of spring 22 assists in moving the shaft 18 back towards its extended position. When latched, the latching portion 44 of the shaft 18 engages the receptacle of the second member. In the present embodiment, means for retaining the shaft 18 in its retracted position is provided. In this embodiment, the retaining means comprises at least one resilient tab and at least one groove between the housing 16 and shaft 18. In the illustrated embodiment, the housing 16 includes a pair of resilient tabs or fingers 36 each generally rectangular attached to its outer surface and the shaft 18 includes a groove 48 within the outer surface and extending entirely around the perimeter. As illustrated in FIG. 6, each of the tabs 36 include projections 37' extending from an inner surface which are adapted to come into engagement with the groove 48 of the shaft 18 when the shaft 18 is moved into its retracted position. Each of the resilient fingers or tabs 36 is formed in an elongated opening 39 extending through the wall of the housing 16. Each of the resilient fingers or tabs 36 extends from a portion of the peripheral wall of the respective opening 39 closest to the flange 30 toward the threaded portion 32 of the housing 16. Each of the resilient fingers or tabs 36 is made integrally with the housing 16. The spring-like properties of the tabs 36 allow the camming member 37 to ride over the outer surface of the shaft 18 and into the groove 48. In addition, in this embodiment, preferably the groove 48 is generally radiused in cross-section to allow movement of the camming members 37 of the tabs 36 into and out of engagement.

In addition, in the illustrated embodiment, means to retain the shaft in an extended position is also provided by a second groove 46 at spaced separation from the groove 48 and positioned adjacent the shoulder 45 of shaft 18. In a similar manner, the camming members 37 of the tabs 36 will move into the groove 46 when the shaft 18 is moved to its extended position.

In FIGS. 16–32 is illustrated another embodiment of a plunger mechanism in accordance with the present invention. The plunger mechanism 110 in the present embodiment is similar to the plunger mechanism 10, and for the sake of brevity, only those portions of the present embodiment which differ from the plunger mechanism 10 will be described. In this embodiment, the plunger mechanism 110 is moveable between retracted and extended positions by a lifting and turning motion of the knob 120. The knob 120 in this embodiment is a T-handle, although as should be understood, any type of knob can be utilized with any of the embodiments in the present invention. The lifting and turning motion of the knob 120 in this embodiment is required for driving of the shaft 118 due to the relationship between the shaft 118 and the housing 116, which will be described below. In addition, similar to the plunger mechanism 10, the plunger mechanism 110 also includes means for retaining the shaft 118 in its retracted position and is provided between the shaft 118 and the housing 116. For these operations, at least one projection and at least one groove is provided between the shaft 118 and housing 116. In this embodiment, preferably two projections 136 are provided defining opposing ends of a pivot pin extending through an opening through the shaft 118, and the housing 116 includes two opposing groove members 146. In the present embodiment, each of the grooves 146 include a substantially axial component comprising a channel 147 provided within the inner surface of the housing 116 and a generally lateral component connected to the channel 147 and comprising a generally radiused camming slot 149 extending through the wall of the housing 116. For assembly, preferably the handle 120 is mounted to the shaft 118 following mounting of the spring member, and in this embodiment, also preferably following mounting of the shaft 1 18 in the housing 116. For mounting of the shaft 118 in the housing 116, preferably the pin that has been installed on the shaft 118 is then inserted into the channels 147 as the shaft 118 is received into the opening through the housing 116. Alternatively, the shaft 118 can be attached with the knob 120 and then the shaft 118 can be inserted into the housing 116 without the pin, and the pin can then be installed by being inserted through the slots 149 in the housing 116 and into the opening through the shaft 118.

The operation of the plunger mechanism 110 will now be described. Movement of the shaft 118 into its retracted position is accomplished by lifting of the handle 120 in an axial direction due to movement of the projections 136 of the pin within the channels 147 of the housing 116. The turning motion of the knob 120 thereafter moves the projections 136 of the pin into the slots 149 of the housing 116. When the knob 120 has been fully turned, the projections 136 of the pin are positioned within the downwardly sloped portions of the cam slots 149 and the shaft 118 is thereby retained in its retracted position. Thereafter, for movement of the shaft 118 back toward its extended position, the knob 120 is first turned in its opposite direction which moves the projections 136 also in the opposite direction within the slots 149. The bias provided by the spring operates to assist in moving the shaft 118 toward its extended position as the projections 136 of the pin are moved past the upper most peak of the cam slots 149. In addition, in this embodiment, when the shaft 118 is in its extended position, the end of the knob 120 is in engagement with the housing 116 adjacent to the flange.

Figure 33:
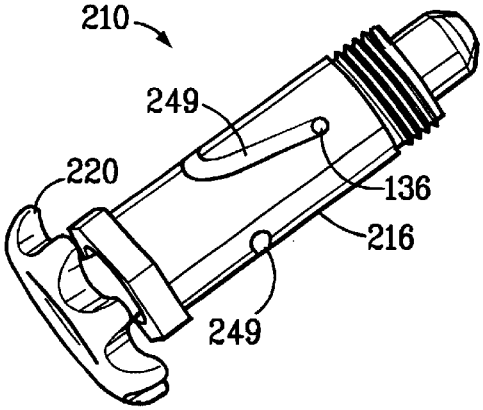
FIG. 33 is a perspective view of a plunger mechanism in accordance with another embodiment of the present invention.
Figure 34:
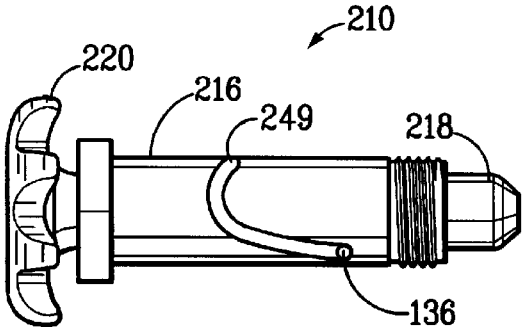
FIG. 34 is a left side elevational view of the plunger mechanism of FIG. 33, the right side being mirror image.

Another embodiment of the plunger mechanism of the present invention is illustrated in FIGS. 33 and 34. The plunger mechanism 210 in this embodiment is again similar to the plunger mechanisms 10 and 110 and only those portions which are different will be described in detail herein. In this embodiment, movement of the shaft 218 between its extended and retracted positions is accomplished through only rotation of the knob 220. The knob 220 in this embodiment includes alternating raised and lowered projections at its perimeter. To accomplish movement of the shaft 218 in the present embodiment, at least one projection and at least one groove is provided between the shaft 218 and housing 216. In this embodiment, two projections are provided by a pivot pin extending through the shaft 218 similar to that illustrated with respect to the plunger mechanism 110. In addition, two grooves are provided in the housing 216 in this embodiment comprising opposing cam slots 249 extending through the wall of the housing 216 and which is generally J-shaped in configuration. The remaining components are the same as that earlier described. For assembly, the shaft 118 is inserted into the opening through the housing 216, followed then by inserting the pin through one slot 249, then into the opening through the shaft 218 and finally out through the opposing slot 249. The knob 220 can be attached to the shaft 218 either before or after the shaft 218 has been installed in the housing 216. In operation, when the shaft 218 is in its extended position, the pin is at the lower end of the cam slots 249 closest to the latching portion of the shaft 218. Subsequent turning motion of the knob 220 will move the projections 136 of the pin up through the cam slots 249 in the direction of the flange causing corresponding movement of the shaft 218 toward its retracted position. After the knob 220 has been fully turned, the projections 136 of the pin are positioned in the downwardly sloped portions of the cam slots 249 which operate to retain the shaft 218 in its retracted position. For movement of the shaft 218 back toward its extended position, the knob 220 is rotated in its opposite direction which accordingly drives the projections 136 in the opposite direction within the cam slots 249. Similar to the latching mechanism 110, after the pin has been moved past the steepest point of the cam slots 249, the bias of the spring will help to urge the shaft 218 toward its extended position.

Another embodiment of a plunger mechanism of the present invention is illustrated in FIGS. 35–40. The plunger mechanism 310 of the present embodiment for purposes of illustration includes a t-handle 320 similar to the handle 120 illustrated in FIG. 16 and a housing 316 and a shaft 318 similar in design as that of the housing 16 and shaft 18 illustrated in FIGS. 1–15. As will be described in more detail below, the new features of the plunger mechanism 310 of the present embodiment are means for regulating rotation of the handle 320 and/or shaft 318 relative to the housing 316 and means for covering the end of the shaft 318 distal the handle 320. These features can be provided separately or in combination together in any of the illustrated embodiments of this application as well as in other devices.

Figure 35:
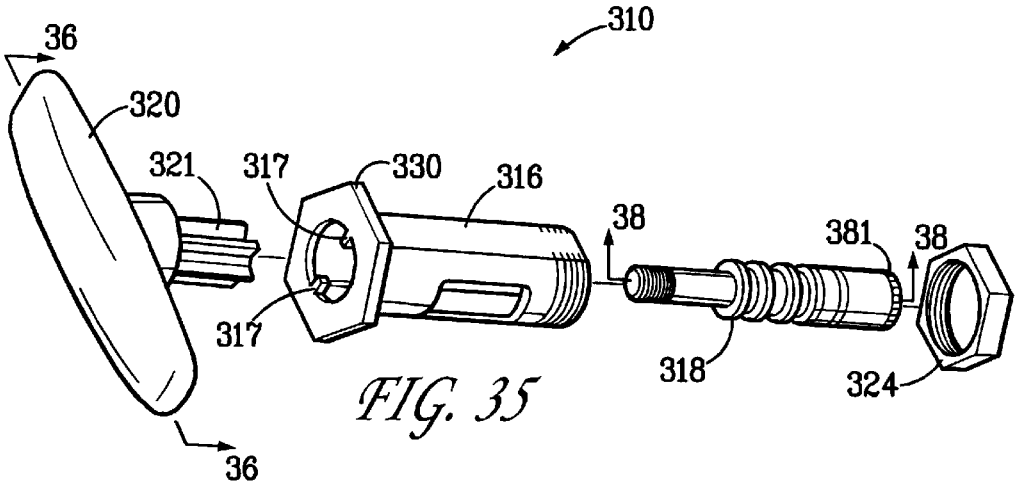
FIG. 35 is an exploded perspective view of a plunger mechanism in accordance with another embodiment of the present invention.
Figure 36:
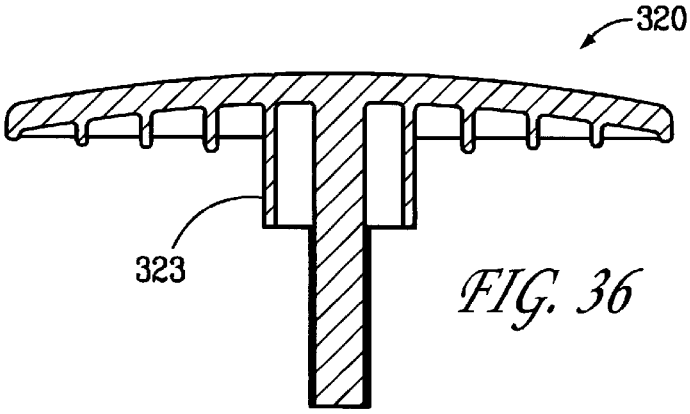
FIG. 36 is a front sectional view of a handle of the plunger mechanism of FIG. 35 slightly enlarge d taken along the line 36—36 of FIG. 35.
Figure 37:
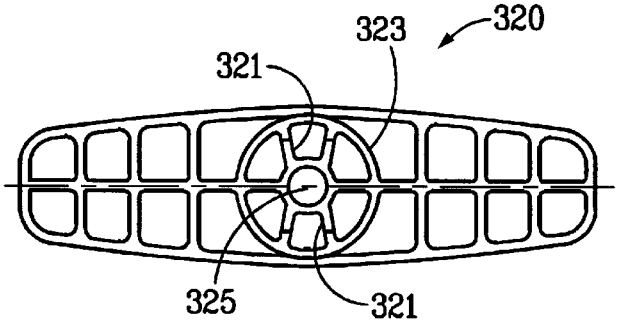
FIG. 37 is s bottom plan view of the handle of FIG. 36.
Figure 38:
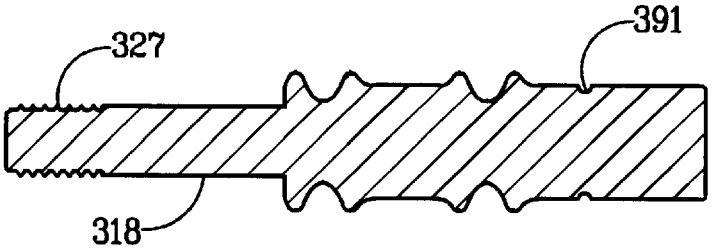
FIG. 38 is a front sectional view of a shaft of FIG. 35 slightly enlarged and taken along the line 38—38 of FIG. 35.

The regulating means in the present embodiment comprises at least one boss 317 provided on the housing 316 received within at least one opening 321 provided in the handle 320. In the illustrated embodiment, there are two bosses 317 as shown in FIG. 35 and two openings 321 in the handle 320 as shown in FIG. 37. The positions of the bosses and the openings can be reversed where desired so that the bosses are on the handle 320 and the openings are on the housing 316. As shown in FIG. 35, the bosses 317 are positioned opposing one another at the flange 330 and extend from the inner surface of the housing 316 defined by the opening extending longitudinally through the housing 316. The handle 320 includes a projection 323 generally elongate and includes the openings 321 on opposite sides, which define channels along the longitudinal direction of the projection 323. Where desired, the regulating means feature can be provided between the shaft 318 and housing 316 in a similar manner. The handle 320 in this embodiment also includes a threaded cavity 325 within the distal end of the projection 323 for screwfit engagement with a threaded end 327 of the shaft 318, although other means can also be utilized for this same purpose.

Figure 39:
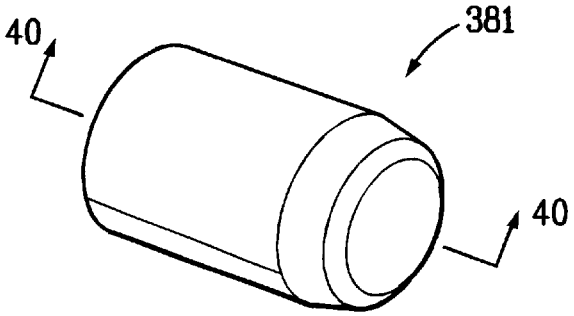
FIG. 39 is a perspective view of a cap of FIG. 35.
Figure 40:
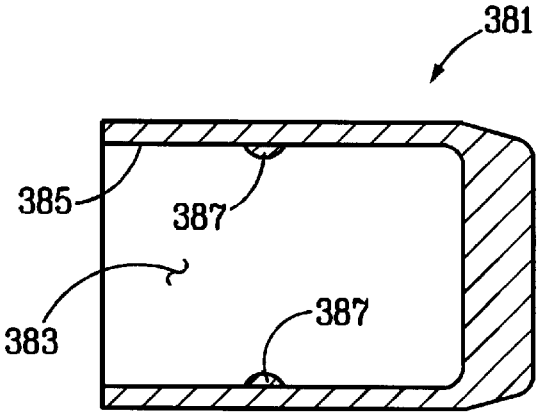
FIG. 40 is a front sectional view of the cap of FIG. 39 slightly enlarged and taken along the line 40—40 of FIG. 39.
Figure 43:
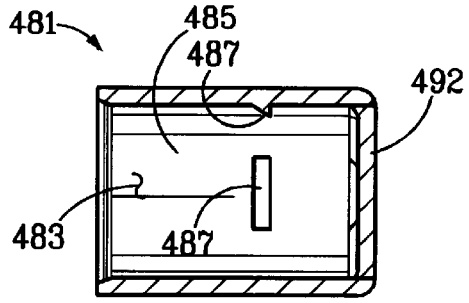
FIG. 43 a front sectional view of the cap of FIG. 41 taken along the line 43—43 of FIG. 42.

The means for covering the distal end of the shaft 318 in the present embodiment comprises a cap 381 as illustrated in FIGS. 35, 39 and 40. The cap 381 in this embodiment is generally elongate and is adapted for snap-fit engagement with the shaft 318. For this purpose, the cap 381 includes a cavity 383 in one end defining an inner surface 385 and at least one boss 387 extending from the inner surface 385. In this embodiment, the cap 381 defines a single ring-shaped boss 387 extending the entire perimeter of the inner surface 385. The shaft 318 in this embodiment includes a channel 391 which extends completely around the perimeter proximate the distal end. As should be understood, the positions of the boss 387 and the channel 391 can be reversed so as to be on the shaft 318 and the cap 381, respectively, where desired. The boss 387 can be provided with a ramped cam surface to facilitate snap-fit attachment with the shaft 318. The material of the cap 381 and/or the shaft 318 can also facilitate attachment, for example, in one embodiment the shaft 318 can be made of metal and the cap 381 can be made of plastic.

In operation of the plunger mechanism 310, the relationship between the bosses 317 and openings 321 on the handle 320 and housing 316 limits rotational movement of the handle 320 and accordingly the shaft 318 as the handle 320 is reciprocated between its extended and retracted positions. The cap 381 on the shaft 318 protects damage being done to the second member, such as a panel on a pick-up truck as is described with respect to the plunger mechanism 10.

The various components of the plunger mechanisms described above can be comprised of any of a variety of suitable materials and made from any of a number of different manufacturing processes. For example, the components can be comprised of plastic and/or metal. As described earlier, in one embodiment of the plunger mechanism 310, the shaft 318 can be of metal and the cap 381 can be of plastic. In operation, the plastic material of the cap 381 can also work to reduce the chances of damage being done to the second member on latching.

Figure 44:
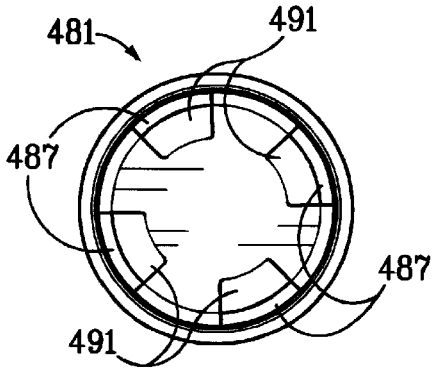
FIG. 44 is a left side view of the cap of FIG. 41.
Figure 41:
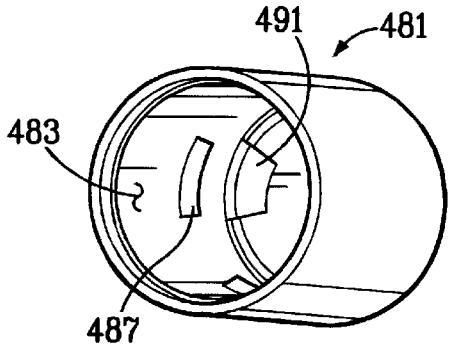
FIG. 41 a left side partially front perspective view slightly enlarged of another embodiment of a cap of FIG. 35.
Figure 42:
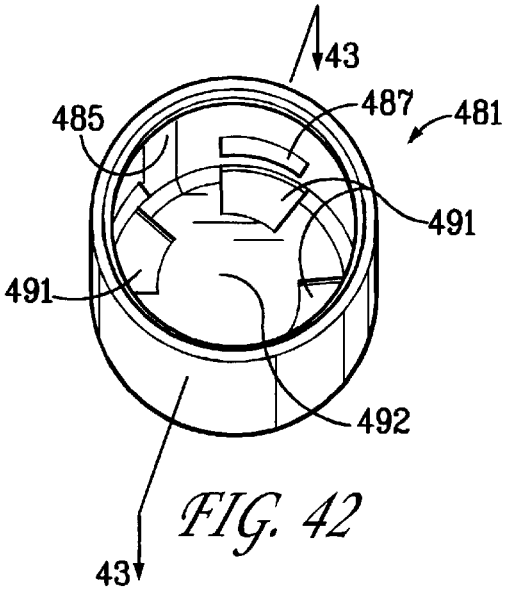
FIG. 42 is a left side partially bottom perspective view of the cap of FIG. 41.

Another embodiment of a covering means for the shaft 318 is illustrated in FIGS. 41–44 comprising a cap 481. The cap 481 is similar to the cap 381, and for the sake of brevity, only the portions which are different will be described in detail herein. The cap 481 preferably includes at least one boss 487 and more preferably four bosses 487 extending from its inner surface 485 to accommodate snap-fit attachment with the shaft 318. In the present embodiment, the four bosses 487 are spaced on the inner surface 485 at approximately 45 degree intervals and each include a ramped cam surface to facilitate snap-fit attachment with shaft 318. The cap 481 also preferably includes at least one opening 491 within its end portion 492 and in the present embodiment four openings 491 are provided within end portion 492, as is illustrated in FIGS. 41, 42 and 44. In a presently preferred embodiment, the number of openings 491 correspond to the number of bosses 487, although that is not required. In other embodiments, only the bosses 487 or the openings 491 can be provided. In the present embodiment, each of the four openings 491 are positioned adjacent to the perimeter and at approximately 45 degree intervals substantially aligned with one of the four bosses 487. Other positions and spacing between the bosses 487 and openings 491 are also possible. In addition, in this embodiment, each of the openings 491 are generally rectangular and have a width substantially corresponding to a width of each of the bosses 487, although other configurations can also be utilized where desired. The openings 491 can serve two purposes. For example, in a preferred embodiment, the cap 481 is comprised of molded plastic and the openings 491 are utilized during the manufacturing stage, in particular, in molding of the bosses 487. Specifically, during manufacture of the bosses 487, access for the molding equipment is provided through the cavity 483 on one end and through the openings 491 on the opposite end. As should be understood, the cap 481 can be made of other materials and by other manufacturing processes as well, and in those instances, access through the openings 491 may not be required. Another purpose of the openings 491 is to facilitate assembly of the cap 481 to the shaft 318. In particular, the openings 481 allow for the escape of air as the cap 481 is being snap-fit on the shaft 318. The result is that the cap 481 is both easier to snap on and a tighter fit is provided between the cap 481 and the shaft 318.

Figure 45:
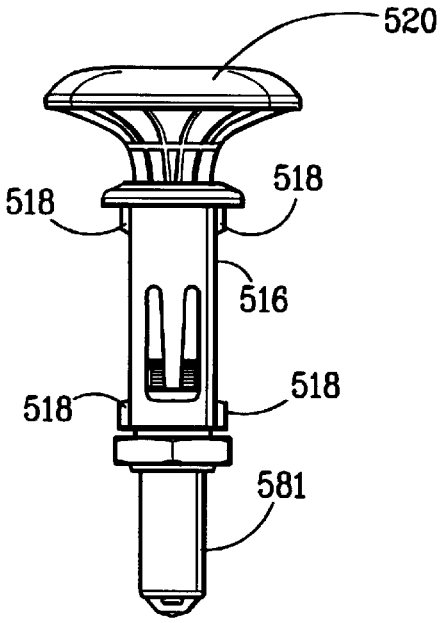
FIG. 45 is a front elevational view of another embodiment of a plunger mechanism in accordance with the present invention illustrated in an extended position, the rear elevational view being a mirror image.
Figure 46:
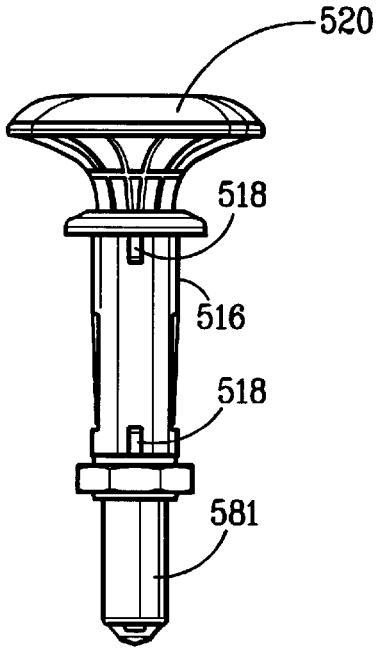
FIG. 46 is a right side elevational view of the plunger mechanism of FIG. 45, the left side being a mirror image.
Figure 47:
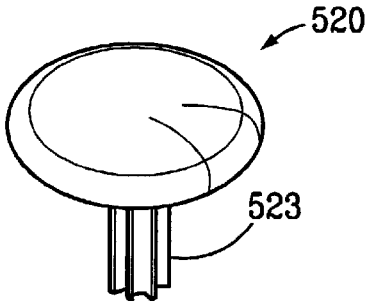
FIG. 47 is an isolated perspective view of a handle of the plunger mechanism of FIG. 45.

In FIG. 45–47 is illustrated another embodiment of a plunger mechanism in accordance with the present invention. For the sake of brevity, the present embodiment will be described in relation to the earlier embodiments by describing the particular features that are similar and those that are different. In the present embodiment, the housing 516 is the same as the housing 316 except for the addition of at least one, and in this embodiment, four bosses 518 extending from its outer surface. In operation, the bosses 518 are received in corresponding shaped openings provided in the member to which the plunger mechanism is mounted, which functions to restrict rotation of the plunger mechanism. The shaft of the present embodiment, although not shown, is the same as the shaft 318. The handle 520 of the present embodiment is similar to the handle 320 by a projection 523 that is similar to the projection 323 but slightly longer in longitudinal length. The overall configuration of the handle 520 is similar to the handle 20, which is in the form of a knob generally conical in shape. The cap 581 is similar to the cap 481.

In view of that set forth above, it should be understood that there can be a number of different variations of the present invention and the illustrated embodiments are just some of the variations that are possible as will be illustrated with reference to the appended claims.

We claim:

1. A plunger mechanism adapted for attachment to a first member having at least one aperture, the plunger mechanism being used for selectively latching the first member to a second member having a keeper in the form of a receptacle, the plunger mechanism comprising:

a substantially tubular housing adapted to extend at least in part through at least a portion of the at least one aperture of the first member when the plunger mechanism is mounted to the first member, said housing having a longitudinal axis and a bore extending longitudinally through said housing, said housing having a first end and a second end, said housing having a flange adjacent said first end of said housing, and said housing being coaxial with the at least one aperture of the first member when the plunger mechanism is mounted to the first member;

means for securing the plunger mechanism to the first member, said means for securing the plunger mechanism engaging a portion of said housing adjacent said second end of said housing, said means for securing the plunger mechanism and said flange cooperating to releasably secure the plunger mechanism to the first member when the plunger mechanism is mounted to the first member;

an elongated shaft positioned at least in part within said bore of said housing, said elongated shaft being coaxial with said bore of said housing, and said shaft being disposed for selective movement between an extended and a retracted position relative to said housing in the direction of said longitudinal axis of said housing, said shaft being provided with first and second grooves, said first and second grooves being spaced apart along the length of said shaft;

means for selectively retaining said shaft in at least one of said shaft's extended and retracted positions, said means for selectively retaining said shaft including at least one resilient finger being elongated and having a longitudinal axis extending substantially parallel to said longitudinal axis of said housing, said resilient finger being attached at a first end thereof to said housing and having a projection at a second end of said resilient finger distal from said first end of said resilient finger, said projection at said second end of said resilient finger being biased toward said longitudinal axis of said housing, said projection at said second end of said resilient finger engaging said first groove when said shaft is in said retracted position, and said projection at said second end of said resilient finger engaging said second groove when said shaft is in said extended position; and means for driving said shaft, said means for driving said shaft being attached to said shaft, said means for driving said shaft allowing an operator to selectively move said shaft between said retracted position and said extended position, whereby the plunger mechanism latches the first member to the second member when the plunger mechanism is mounted to the first member and the shaft is moved to the extended position in order to engage the receptacle of the second member.

2. A plunger mechanism according to claim 1, wherein said housing has a threaded portion adjacent said second end of said housing and said means for securing the plunger mechanism is a nut having threads, said nut is engaged to said threaded portion of said housing, and said nut and said flange cooperate to releasably secure the plunger mechanism to the first member when the plunger mechanism is mounted to the first member.

3. A plunger mechanism according to claim 1, wherein said means for driving said shaft is one of a knob and a handle.

4. A plunger mechanism according to claim 1, wherein said first and second grooves are annular, and wherein camming surfaces defined by said projection at said second end of said resilient finger distal from said first end of said resilient finger, and said camming surfaces cooperate with said first and second grooves to move said projection at said second end of said resilient finger out of said first and second grooves as said shaft is moved between said retracted and extended positions.

5. A plunger mechanism according to claim 4, wherein said housing has a wall and an elongated opening extending through said wall of said housing, said elongated opening in said wall of said housing has a peripheral wall, and said resilient finger extends from a portion of said peripheral wall of said elongated opening in said wall of said housing toward said second end of said housing.

6. A plunger mechanism according to claim 4, further comprising a biasing member positioned intermediate said second groove and said first end of said housing, said biasing member biasing said shaft toward said extended position.

7. A plunger mechanism according to claim 4, wherein said shaft has a portion which extends from said second end of said housing when said shaft is in said extended position, and wherein said shaft further comprises a cap snap-fitted to at least a terminal portion of said portion of said shaft which extends from said second end of said housing when said shaft is in said extended position.

8. A plunger mechanism according to claim 4, further comprising means for limiting the rotational movement of said shaft relative to said housing.

9. A plunger mechanism adapted for attachment to a first member having at least one aperture, the plunger mechanism being used for selectively latching the first member to a second member leaving a keeper in the form of a receptacle, the plunger mechanism comprising:

a substantially tubular housing adapted to extend at least in part through at least a portion of the at least one aperture of the first member when the plunger mechanism is mounted to the first member, said housing having a longitudinal axis and a bore extending longitudinally through said housing, said housing having a first end and a second end, said housing having a flange adjacent said first end of said housing, and said housing being coaxial with the at least one aperture of the first member when the plunger mechanism is mounted to the first member, said housing having a slot having a first end and a second end, said slot extending at least in part in a circumferential direction about said longitudinal axis of said housing, said housing having a longitudinally extending groove which is contiguous and communicates with said second end of said slot, said slot having an uppermost peak intermediate said first and second ends of said slot, and said slot having a downwardly sloped portion extending from said uppermost peak to said first end of said slot;

means for securing the plunger mechanism to the first member, said means for securing the plunger mechanism engaging a portion of said housing adjacent said second end of said housing, said means for securing the plunger mechanism and said flange cooperating to releasably secure the plunger mechanism to the first member when the plunger mechanism is mounted to the first member;

an elongated shaft positioned at least in part within said bore of said housing, said elongated shaft being coaxial with said bore of said housing, and said shaft being disposed for selective movement between an extended and a retracted position relative to said housing in the direction of said longitudinal axis of said housing, said shaft having a projection engaged to one of said longitudinally extending groove and said slot, said projection of said shaft being positioned within said downwardly sloped portion of said slot to retain said shaft in the retracted position, and said shaft being movable between said retracted and said extended positions by a combination of turning and axial movement of said shaft; and means for driving said shaft, said means for driving said shaft being attached to said shaft, said means for driving said shaft allowing an operator to selectively move said shaft between said retracted position and said extended position, whereby the plunger mechanism latches the first member to the second member when the plunger mechanism is mounted to the first member and the shaft is moved to the extended position in order to engage the receptacle of the second member.

10. A plunger mechanism according to claim 9, further comprising a biasing member positioned intermediate said projection of said shaft and said first end of said housing, said biasing member biasing said shaft toward said extended position.

11. A plunger mechanism according to claim 9, wherein said shaft has a portion which extends from said second end of said housing when said shaft is in said extended position, and wherein said shaft further comprises a cap snap fitted to at least a terminal portion of said portion of said shaft which extends from said second end of said housing when said shaft is in said extended position.

12. A plunger mechanism adapted for attachment to a first member having at least one aperture, the plunger mechanism being used for selectively latching the first member to a second member having a keeper in the form of a receptacle, the plunger mechanism comprising:

a substantially tubular housing adapted to extend at least in part through at least a portion of the at least one aperture of the first member when the plunger mechanism is mounted to the first member, said housing having a longitudinal axis and a bore extending longitudinally through said housing, said housing having a first end and a second end, said housing having a flange adjacent said first end of said housing, and said housing being coaxial with the at least one aperture of the first member when the plunger mechanism is mounted to the first member, said housing having a slot having a first end and a second end, said slot extending at least in part in a circumferential direction about said longitudinal axis of said housing, said first end of said slot being closer to said first end of said housing as compared to said second end of said slot, a portion of said slot intermediate said first and second ends of said slot lying closer to said first end of said housing as compared to said first and second ends of said slot;

means for securing the plunger mechanism to the first member, said means for securing the plunger mechanism engaging a portion of said housing adjacent said second end of said housing, said means for securing the plunger mechanism and said flange cooperating to releasably secure the plunger mechanism to the first member when the plunger mechanism is mounted to the first member;

an elongated shaft positioned at least in part within said bore of said housing, said elongated shaft being coaxial with said bore of said housing, and said shaft being disposed for selective movement between an extended and a retracted position relative to said housing in the direction of said longitudinal axis of said housing, said shaft having a projection engaged to said slot, said projection of said shaft being positioned at said first end of said slot to retain said shaft in the retracted position, said projection of said shaft being positioned at said second end of said slot when said shaft is in said extended position, and said shaft being moved between said retracted and said extended positions by a combination of turning and axial movement of said shaft; and means for driving said shaft, said means for driving said shaft being attached to said shaft, said means for driving said shaft allowing an operator to selectively move said shaft between said retracted position and said extended position, whereby the plunger mechanism latches the first member to the second member when the plunger mechanism is mounted to the first member and the shaft is moved to the extended position in order to engage the receptacle of the second member.

13. A plunger mechanism according to claim 12, further comprising a biasing member positioned intermediate said projection of said shaft and said first end of said housing, said biasing member biasing said shaft toward said extended position.

14. A plunger mechanism according to claim 12, wherein said shaft has a portion which extends from said second end of said housing when said shaft is in said extended position, and wherein said shaft further comprises a cap snap fitted to at least a terminal portion of said portion of said shaft which extends from said second end of said housing when said shaft is in said extended position.

15. A plunger mechanism adapted for attachment to a first member having at least one aperture, wherein the first member has at least one cavity contiguous with the at least one aperture of the first member, the plunger mechanism being used for selectively latching the first member to a second member having a keeper in the form of a receptacle, the plunger mechanism comprising:

a substantially tubular housing adapted to extend at least in part through at least a portion of the at least one aperture of the first member when the plunger mechanism is mounted to the first member, said housing having a longitudinal axis and a bore extending longitudinally through said housing, said housing having a first end and a second end, said housing having a flange adjacent said first end of said housing, and said housing being coaxial with the at least one aperture of the first member when the plunger mechanism is mounted to the first member;

means for securing the plunger mechanism to the first member, said means for securing the plunger mechanism engaging a portion of said housing adjacent said second end of said housing, said means for securing the plunger mechanism and said flange cooperating to releasably secure the plunger mechanism to the first member when the plunger mechanism is mounted to the first member;

an elongated shaft positioned at least in part within said bore of said housing, said elongated shaft being coaxial with said bore of said housing, and said shaft being disposed for selective movement between an extended and a retracted position relative to said housing in the direction of said longitudinal axis of said housing;

means for limiting the rotational movement of the plunger mechanism relative to the first member when the plunger mechanism is mounted to the first member, said means for limiting the rotational movement of the plunger mechanism relative to the first member including at least one boss projecting from said housing and adapted to engage the at least one cavity; and means for driving said shaft, said means for driving said shaft being attached to said shaft, said means for driving said shaft allowing an operator to selectively move said shaft between said retracted position and said extended position, whereby the plunger mechanism latches the first member to the second member when the plunger mechanism is mounted to the first member and the shaft is moved to the extended position in order to engage the receptacle of the second member.

* * * * *

UNITED STATES PATENT AND TRADEMARK OFFICE

CERTIFICATE OF CORRECTION

PATENT NO. : 6,299,223 B1
DATED : October 9, 2001
INVENTOR(S) : Lianli Ji et al.

Figure 5:
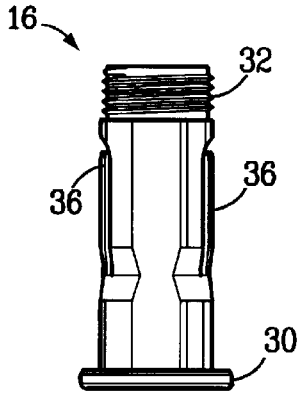
FIG. 5 is a elevational view of the housing of FIG. 4.
Figure 9:
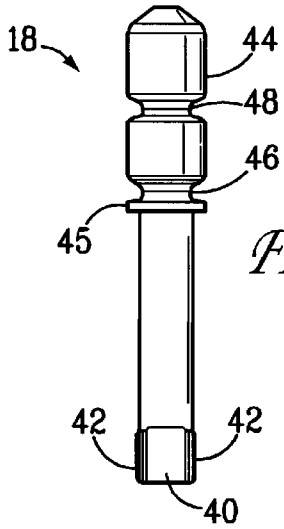
FIG. 9 is a elevational view of the shaft of FIG. 8.
Figure 10:
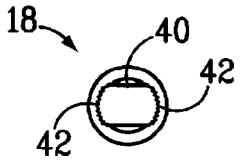
FIG. 10 is a bottom plan view of the shaft of FIG. 8.
Figure 11:
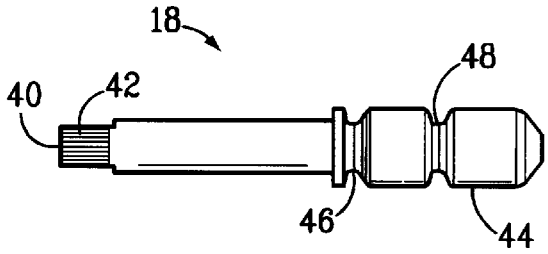
FIG. 11 is a left side elevational view of the shaft of FIG. 8, the right side being a mirror image.
Figure 12:
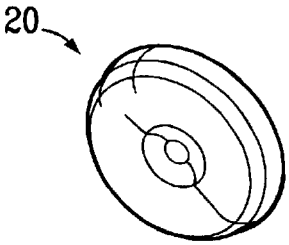
FIG. 12 is an isolated perspective view of a knob of the plunger mechanism of FIG.
Figure 13:
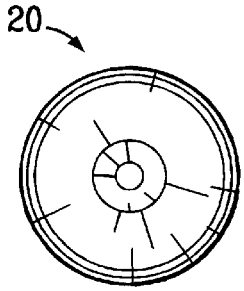
FIG. 13 is a front elevational view of the knob of FIG. 12.
Figure 14:
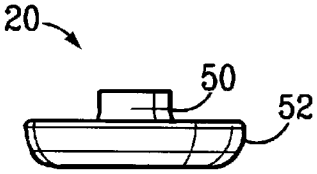
FIG. 14 is a bottom plan view of the knob of FIG. 12, the top plan view being a mirror image.
Figure 15:
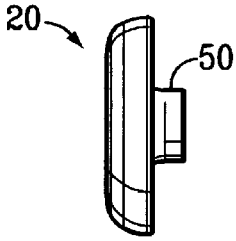
FIG. 15 is a left side elevational view of the knob of FIG. 12, the right side being a mirror image.
Figure 20A:
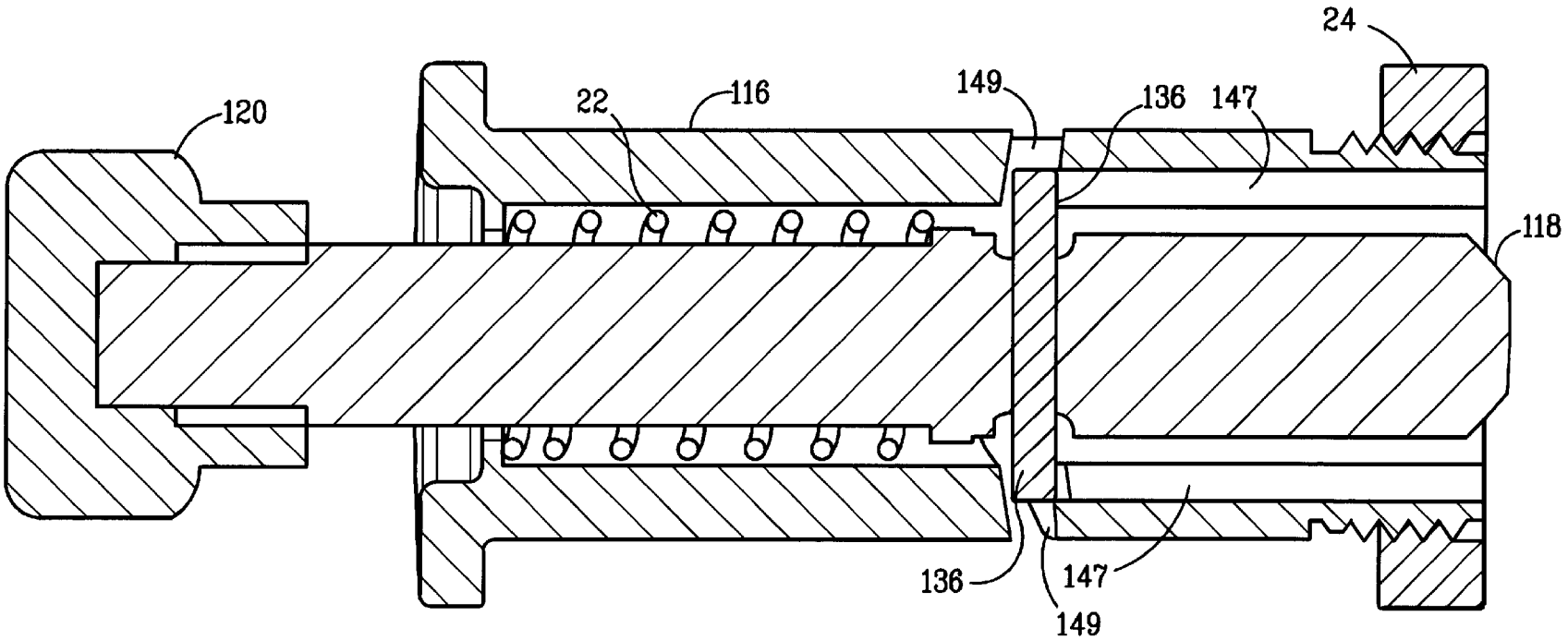
FIG. 20*a* is a sectional view of the plunger mechanism of FIG. 16, taken longitudinal through the center.
Figure 21A:
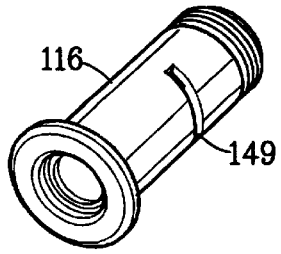
FIG. 21*a* is an isolated perspective view of a housing of the plunger mechanism of FIG. 16.
Figure 21B:
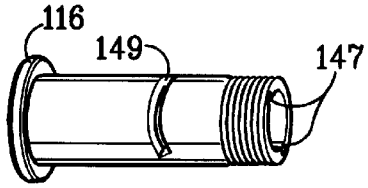
FIG. 21*b* is another perspective view of the housing of FIG. 21*a*.
Figure 22:
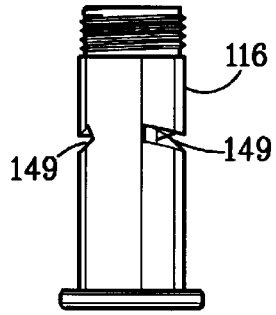
FIG. 22 is a front elevational view of the housing of FIG. 21*a*.
Figure 23:
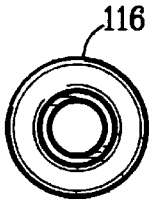
FIG. 23 is a top plan view of the housing of FIG. 21*a*.
Figure 24:
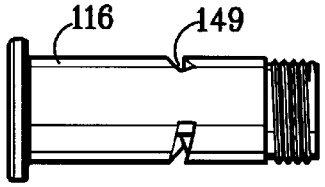
FIG. 24 is a left side elevational view of the housing of FIG. 21*a*, the right side being a mirror image.
Figure 25:
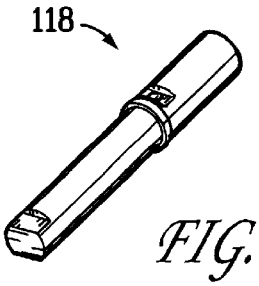
FIG. 25 is an isolated perspective view of a shaft of the plunger mechanism of FIG. 16.
Figure 26:
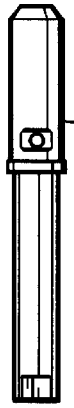
FIG. 26 is a front elevational view of the shaft of FIG. 25.
Figure 27:
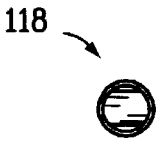
FIG. 27 is a bottom plan view of the shaft of FIG. 25.
Figure 28:
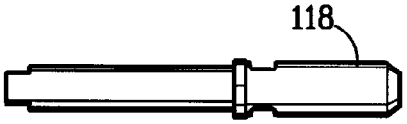
FIG. 28 is a left side elevational view of the shaft of FIG. 25, the right side being a mirror image.
Figure 29:
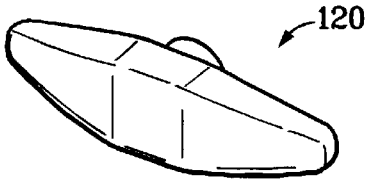
FIG. 29 is an isolated perspective view of a knob of the plunger mechanism of FIG. 16.
Figure 30:
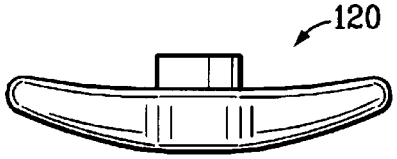
FIG. 30 is a front elevational view of the knob of FIG. 29.
Figure 31:
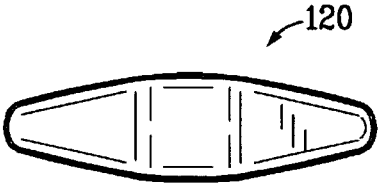
FIG. 31 is a bottom plan view of the knob of FIG. 29.
Figure 32:
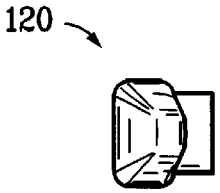
FIG. 32 is a left side elevational view of the knob of FIG. 29, the right side being a mirror image.

It is certified that error appears in the above-identified patent and that said Letters Patent is hereby corrected as shown below:

Column 1,
Line 10, replace “BACKGROUNG OF THE INVENTION” with
-- BACKGROUND OF THE INVENTION --;
Line 41, replace “FIG. 5 is a elevational” with -- FIG. 5 is a side elevational --;
Line 47, replace “FIG. 9 is a elevational” with -- FIG. 9 is a front elevational --;
Line 52, replace “FIG.” with -- FIG. 1. --;

Column 2,
Line 41, replace “enlarge d taken” with -- enlarged and taken --;
Line 49, insert -- is -- after “FIG. 41”;
Line 53, insert -- is -- after “FIG. 43”;

Column 4,
Line 28, between “surface” and “which”, insert -- thereof and defining camming surfaces 37 --;

Column 9,
Lines 37-38, between “wherein” and “camming”, insert -- said resilient finger has --.

Signed and Sealed this

Twenty-seventh Day of April, 2004

JON W. DUDAS
*Acting Director of the United States Patent and Trademark Office*